US005445541A

United States Patent [19]

May et al.

[11] Patent Number: 5,445,541

[45] Date of Patent: Aug. 29, 1995

[54] BLADE CONTACT FOR ELECTRIC PLUGS

[75] Inventors: Guntram May, Altdorf; Helmut Steinhardt, Nürnberg, both of Germany

[73] Assignee: Framatome Connectors International, Paris La Defense, France

[21] Appl. No.: 107,752

[22] PCT Filed: Dec. 18, 1992

[86] PCT No.: PCT/EP92/02954

§ 371 Date: Aug. 18, 1993

§ 102(e) Date: Aug. 18, 1993

[87] PCT Pub. No.: WO93/13572

PCT Pub. Date: Jul. 8, 1993

[30] Foreign Application Priority Data

Jan. 4, 1992 [DE] Germany ..... 42 00 109.9

[51] Int. Cl.[6] ..... H01R 13/422

[52] U.S. Cl. ..... 439/595; 439/884

[58] Field of Search ..... 439/595, 884, 744, 746–749, 439/871, 872

[56] References Cited

U.S. PATENT DOCUMENTS 3,555,496 1/1971 Pearce, Jr. et al. ..... 439/748

4,253,718 3/1981 Bungo ..... 439/603

4,390,231 6/1983 Plyler et al. ..... 439/872

FOREIGN PATENT DOCUMENTS 8902356 8/1990 Germany .

*Primary Examiner*—Neil Abrams

*Attorney, Agent, or Firm*—Pollock, Vande Sande & Priddy

[57] ABSTRACT

In a blade contact for electric plug connectors with a strip-like contact part, a supporting body securable on the plug casing, and with crimping attachments for securing an electrical conductor and its insulation jacket on the blade contact, the support is made safer while reducing the constructional expenditure, and the flow of current is enhanced by the arrangement of a sheet-metal blank cut to size with a substantially rectangular section extending across partial lengths of said blank for forming the contact part, and with a tab on each side projecting beyond the section of forming the contact part, as well as with tabs disposed in line with the section and projecting laterally beyond the latter for forming crimping attachments, and of which the tabs are bent back outward rearwardly, whereas the tabs for the crimping attachments are set obliquely outward.

12 Claims, 2 Drawing Sheets

BLADE CONTACT FOR ELECTRIC PLUGS

FIELD OF THE INVENTION

The invention relates to a blade contact for electric plug connectors with a strip-like contact part, a supporting body fixable on the plug casing, and with crimping attachments for securing an electrical conductor and its insulating jacket on the blade contact.

BACKGROUND OF THE INVENTION

It is known that blade contacts have to be fixed in the plug casing in the direction of plugging. For this purpose, one known blade contact has a contact part provided with a fastening recess and having transversely projecting jags, which are folded back across partial lengths, resting one on top of the other. Due to the fastening recess, the blade contact is mechanically unstable and weakened in the cross section next to the recesses; this unfavorably influences the flow of current. Furthermore, the blade contact is not capable of miniaturization. Another known blade contact is embraced across a partial length by a box tube-like, molded sheet-metal part for creating a supporting body, which part can be slipped on and secured on the contact part by means of tongue-shaped jags that can be bent into recesses of the contact part. The molded sheet-metal part acting as the supporting body is not only costly to produce, but also does not safely secure the contact blade.

SUMMARY OF THE INVENTION

The object of the invention is to reduce the constructional expenditure for blade contacts of the above type, to make the support of the blade contact in the plug casing more secure, and to create the precondition for a favorable flow of current.

According to the invention, this object is achieved as follows. A metal sheet is cut to size, with a substantially rectangular section extending across partial lengths thereof to form the contact part, and a tab on each of its two sides projecting beyond the rectangular section to form the supporting body, as well as additional tabs disposed in line with the section and laterally projecting beyond the latter for forming crimping attachments. The metal sheet is folded in by 90° on itself in a plane-parallel way along a common fold line substantially over the axial length of the section forming the contact part and of the tabs, and the tabs of which are bent back outwardly, whereas the tabs for the crimping attachments are set obliquely outwards, or with a spacing parallel with the plane of the fold line. The blade contact can be formed from a single sheet-metal blank cut to size, by simple bending processes. This results in a simple development and advantageous realizability of the blade contact in terms of tool engineering, and assures exact securing of its position in the plug casing. Furthermore, the blade contact is characterized by a mechanical ruggedness that permits the utilization of materials having lower strength, but high electrical conductivity. Finally, by omitting fastening recesses, the flow of current in the blade contact is left unimpaired.

Preferably, the tabs have curved segments and plane segments connecting up with said curved segments, whereby the curved segments and the plane segments of the tabs project beyond the section of the sheet-metal blank cut to size forming the contact part. In this connection, the curved segments are shaped in such a way that the section forming the contact part and the tabs forming the supporting body have a substantially meander-like cross section transversely to the direction of plugging. It is possible in this connection to design the supporting body with any desired width relative to the contact part by selecting the radii on the curved segments accordingly.

In developing the blade contact, provision is made that the plane segments of the tabs extend either in a plane-parallel way relative to each other, or obliquely outwards toward the free end. In this connection, the tabs can be wholly or partly rigid or elastic, so that the blade contact with the tabs is insertable and securable in the plug casing under prestress, if need be.

Furthermore, provision is made to bend the free end of the plane segment of at least one tab inwardly across a partial length and/or partial width transversely to the plane of the fold line in order to form a box tube-like supporting body. Preferably, the free ends of both segments have inward bends directly against each other approximately across half of their axial length.

In a further development, the curved segments have at least one inward or outward depression serving as a reinforcement, for example a corrugation. In this way, unintentional bending back of the tabs is avoided, for example when the blade contact is being inserted in the plug casing. Furthermore, the tabs may have recesses in the zone of the curved segments and/or across partial widths of the plane segments.

Finally, measures for easier plugging of the blade contact in associated contact sockets are achievable if the section forming the contact part has a slotting extending at the free plug end in the fold line across a partial length, and if the ends of the contact part segments so formed next to the slotting are bent inwardly toward the free end. In addition, offsets, for which provision may be made, if need be, in the marginal edge zones of the longitudinal edges of the contact part segments, permit the formation of an insertion tip on the blade contact.

BRIEF DESCRIPTION OF THE DRAWINGS

The invention will now be explained on the basis of an exemplary embodiment shown in the drawing, in which.

DETAILED DESCRIPTION

Figure 1:
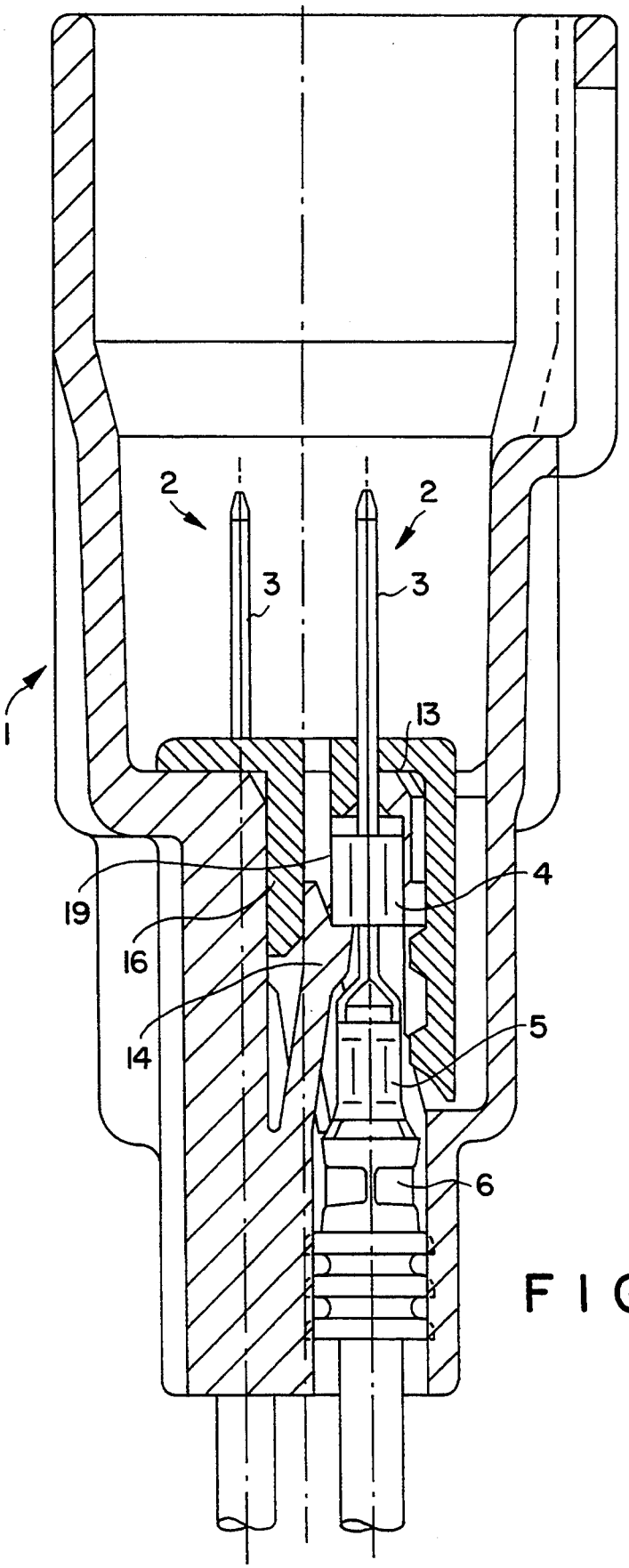
FIG. 1 shows a sectional view of a plug casing with a blade contact.
Figure 2:
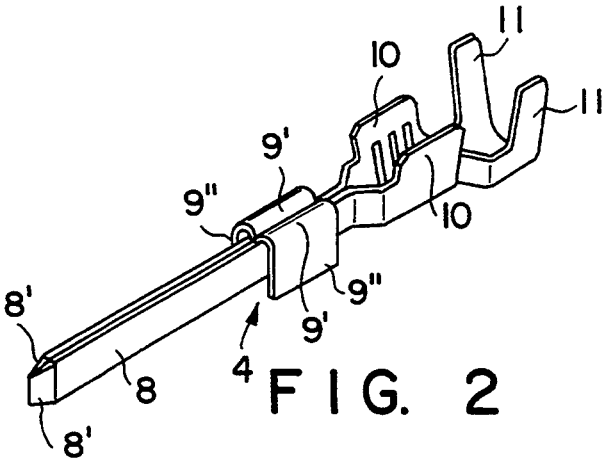
FIG. 2 is a perspective view of a blade contact.
Figure 5:
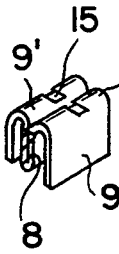
FIG. 5 shows a part section of a blade contact within the zone of line V—V of FIG. 2.

The drawings show a plug casing 1 for receiving the blade contacts 2. The individual blade contact 2 has a contact part 3, a supporting body 4 for the purpose of axial fixation of the blade contact 2 in the plug casing 1, and the crimping attachments 5 and 6. The blade contact 2 is formed by one single cut-to-size sheet-metal blank 7 which, across partial lengths, has a substantially rectangular section 8 for forming the contact part 3, and the tabs 9, 10 and 11 for forming the supporting body 4 and the crimping attachments 5 and 6, the tabs laterally projecting beyond the section 8. With the section 8, the cut-to-size sheet-metal blank 7 is folded along a fold line 12 across the length of the blade contact 2 and the supporting body 4 by 90° onto the tabs 9 extending on both sides of the fold line 12. FIG. 2 shows that the tabs 9 forming the supporting body 4 are bent back across the curved segments 9′, resulting within the zone of the supporting body 4 in a substantially-meander-shaped cross section through the contact part 3 and the tabs 9 (FIG. 5). The curved segments 9′ and the plane segments 9″ connecting up with the curved segments 9′ project beyond the contact part 3 parallel with the plane of the fold line, forming in this way supporting surfaces on the supporting body which, when the blade contact 2 is inserted in the plug casing 1, come to rest against the plug casing surfaces at 13 (FIG. 1). In the plug casing 1, the supporting body 4 is grippable from behind by a bendable attachment 14 flexibility mounted on the plug casing (FIG. 1). The attachments is fixable in the gripping position by means of a clamping body 16, which can be pushed into the plug casing 1. The curved segments 9′, or the curved segments 9′ and parts of the plane segments 9,″ can be provided with one or more depressions 15 (FIG. 5), which serve to rigidify the curved segments 9′ and help to prevent unintentional bending back of the tabs 9.

Figure 6:
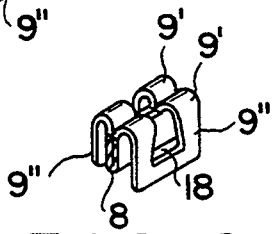

In the embodiment of FIG. 6, the curved segments 9′ and the plane segments 9″ of the tabs 9 are provided with recesses 18, which preferably are trapezoidal. By having clamping bodies (not shown) mounted rigidly on the plug casing engage in the recesses 18, it is possible to obtain or support an axial fixation of the blade contact.

Figure 7:
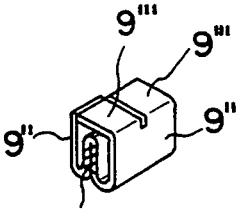
FIGS. 6 and 7 show part sections of a blade contact within the zone of the supporting bodies in accordance with suitably modified embodiments.

In the embodiment of FIG. 7, the free ends of the plane segments 9′ are bent inwardly across part of their length 9‴ in the direction of the fold line plane 12, forming in this way a box tube-like supporting body 4 of great stability.

The tabs 10 and 11 of the cut-to-size sheet-metal blank 7 are oblique relative to the plane of the fold line of the contact part 3 and serve for securing an electrical conductor (not shown) or its insulation.

Figure 8:
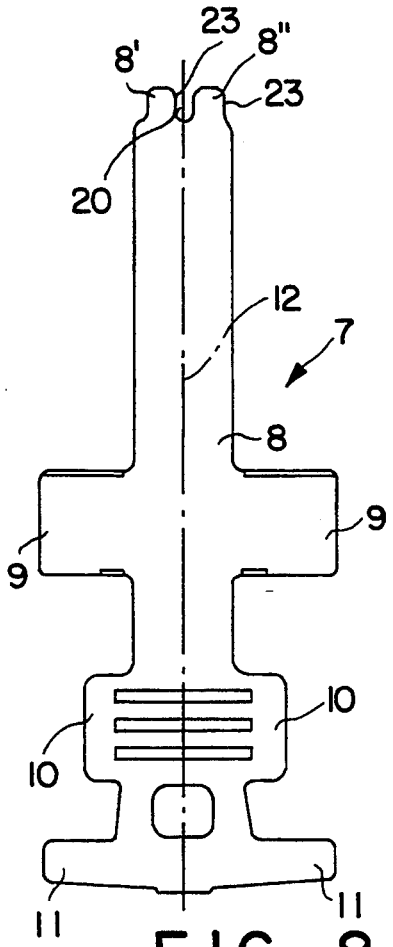
FIG. 8 is a top plan view of a sheet-metal blank cut to size for a blade contact.
Figure 3:
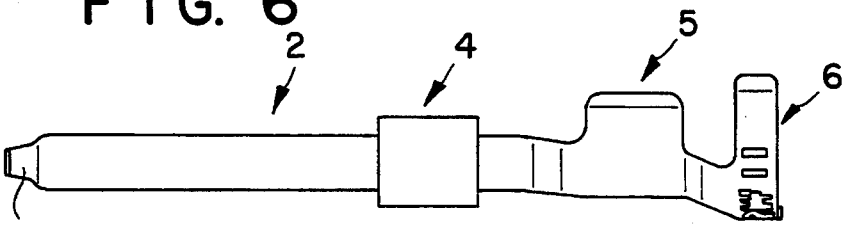
FIG. 3 is a lateral view of a blade contact.
Figure 4:
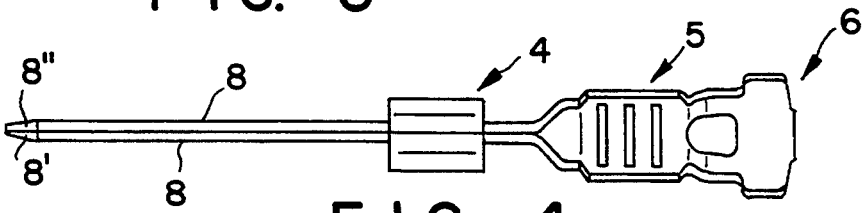
FIG. 4 is a top plan view of a blade contact.
Figure 9:
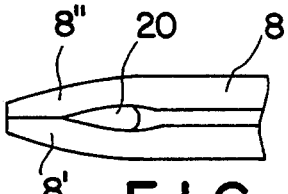
FIG. 9 shows an enlarged view of a blade contact within the zone of the plug end, in a lateral view.

FIGS. 8 and 9 show that the contact part 3 is provided with a slot 20 at the free end of the section 8 across a partial length, and that the free section ends 8′, 8″ so formed are bent inwardly against each other to form an insertion slope. The ends 8′, 8″ facilitate the insertion of the blade contact 2 in associated contact sockets (not shown). In addition, the marginal edges of the free ends 8′, 8″ are provided with offsets 23, which permit the formation of an insertion tip.

We claim:

1. Blade contact for electric plug connectors, said blade contact comprising:

(a) a strip-shaped contact part (3) formed from a plane metal sheet (7) having a substantially rectangular section (8) across portions of a length of said sheet, said contact part (3) comprising a folded segment forming a supporting body (4) to be held between latching surfaces within a plug housing so as to fix said contact in said plug housing;

(b) two tabs (9) respectively projecting from each of two sides of said segment, said tabs being bent outwardly to form said supporting body (4);

(c) additional tabs (10, 11) arranged on said sheet forming crimp attachments (5, 6) for fixing an electrical conductor and insulating jacket of said conductor;

(d) said rectangular section forming said contact part (3) and each said two tabs (9) being folded downwardly by 90° across a substantially axial partial length along a fold line (12) disposed along an axis of said sheet (7), so that portions of said two tabs extend alongside each side of the folded contact part.

2. Blade contact according to claim 1, wherein said two tabs (9) comprise curved segments (9′) and plane segments (9″) connecting up to said curved segments.

3. Blade contact according to claim 2, wherein said curved segments (9′) and said plane segments (9″) project beyond said rectangular section forming said contact part (3).

4. Blade contact according to claim 1, wherein, within the zone of said two tabs (9), said rectangular section and said two tabs jointly form a substantially meander-shaped cross-section transversely to a direction of plugging.

5. Blade contact according to claim 1, wherein said plane segments (9″) of said two tabs (9) are located in mutually parallel planes.

6. Blade contact according to claim 1, wherein said two tabs (9) are resiliently deflectable.

7. Blade contact according to claim 1, wherein a free end of said plane segment (9″) of at least one of said two tabs (9) is bent inwardly transversely to the plane of said fold line (12) across a partial length and partial width so as to form a box tube-like supporting body.

8. Blade contact according to claim 5, wherein said curved segments (9′) have at least one inward depression (15) serving as a stiffening means.

9. Blade contact according to claim 7, wherein said curved segments (9′) have at least one outward depression (15) serving as a stiffening means.

10. Blade contact according to claim 1, wherein said two tabs (9) have recesses (18) within the zone of said curved segments (9′) and partial widths of said plane segments (9″).

11. Blade contact according to claim 1, wherein the section (8) forming said contact part (3) has a slot (20) at a free plug end in said fold line (12) across a partial length, and ends of the contact part sections (8, 8′) extending next to said slot (20) are bent inwardly toward said free end.

12. Blade contact according to claim 11, wherein said contact part sections (8, 8′) have offsets (23) in marginal zones of longitudinal edges of said rectangular section (8).

* * * * *